US008400484B2

(12) United States Patent
Furukawa et al.

(10) Patent No.: US 8,400,484 B2
(45) Date of Patent: Mar. 19, 2013

(54) DEVICE AND APPARATUS FOR CONTROLLING SAME

(75) Inventors: Tatsuo Furukawa, Zama (JP); Nobuyuki Hirayama, Fujisawa (JP); Ryo Kasai, Tokyo (JP); Shinichi Omo, Kawasaki (JP); Hiroyuki Nakamura, Atsugi (JP); Kimiyuki Hayasaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 285 days.

(21) Appl. No.: 12/964,676

(22) Filed: Dec. 9, 2010

(65) Prior Publication Data

US 2011/0310210 A1 Dec. 22, 2011

(30) Foreign Application Priority Data

Jun. 21, 2010 (JP) ..... 2010-140914

(51) Int. Cl.
*B41J 2/35* (2006.01)
*B41J 2/005* (2006.01)

(52) U.S. Cl. ..... 347/211; 347/12

(58) Field of Classification Search ..... 347/211, 347/194, 5, 9, 19, 12
See application file for complete search history.

(56) References Cited

U.S. PATENT DOCUMENTS 7,775,620 B2 * 8/2010 Furukawa ..... 347/20

FOREIGN PATENT DOCUMENTS

JP 2003-226012 A 8/2003
JP 2005-169867 * 6/2005

OTHER PUBLICATIONS

Machine-generated translation of JP 2003-226012, published on Aug. 2003.*
Machine-generated translation of JP 2005-169867, published on Jun. 2005.*

* cited by examiner

*Primary Examiner* — Huan Tran
(74) *Attorney, Agent, or Firm* — Canon U.S.A, Inc. IP Division

(57) ABSTRACT

A device includes a first element substrate and a second element substrate for driving a driving element; a first signal input unit connected to an input terminal of the first element substrate; a second signal input unit connected to an input terminal of the second element substrate; and a signal output unit. Each of the first and second element substrates includes a driving element, a first signal generation unit configured to output a first signal, a second signal generation unit configured to output a second signal, an input terminal, an output terminal, and a selection unit configured to receive a signal from the first and the second signal generation units, select one of a state of the first signal, a state of the second signal, and a high-impedance state on the basis of the selection signal input from the input terminal, and output the state to the output terminal.

6 Claims, 14 Drawing Sheets

| | SEL0 | SEL1 | SEL2 |
|---|---|---|---|
| SEL_OUT0 | L | L | L |
| SEL_OUT1 | H | L | L |
| SEL_OUT2 | L | H | L |
| SEL_OUT3 | H | H | L |
| SEL_OUT4 | L | L | H |
| SEL_OUT5 | H | L | H |
| SEL_OUT6 | L | H | H |
| SEL_OUT7 | H | H | H |

DEVICE AND APPARATUS FOR CONTROLLING SAME

BACKGROUND OF THE INVENTION

1. Field of the Invention

The present invention relates to a device including a plurality of element substrates and, more particularly, relates to the signal output of a device.

2. Description of the Related Art

Japanese Patent Laid-Open No. 2003-226012 discloses a configuration in which a circuit for driving a recording element (heater) as a driving element and a plurality of temperature detection elements are formed on the same semiconductor substrate, a plurality of temperature detection elements are selected, and the outputs of the selected temperature detection elements are output to a common terminal.

However, in a device (recording head) including a plurality of element substrates, if output terminals of temperature detection elements that extend from the substrates are individually provided, the number of terminals of the recording head increases. For this reason, the number of terminals of a device (recording device) that is connected to the recording head increases, causing the recording device to increase in size and increase in cost. Furthermore, if outputs of temperature detection elements are transferred to the recording device through individual corresponding signal lines, variations in the signal lines cause the output values of the temperature detection elements to differ.

In order to solve the above-described problem, a configuration is assumed in which the output terminals of temperature detection elements, which extend from each of substrates are connected in common within the recording head. In a case where the output terminals of temperature detection elements are simply connected in common, output voltages from each substrate collide in the commonly connected wiring. For this reason, it is not possible to output an accurate voltage value from the recording head. Such a problem is a problem common to other devices and not just limited to recording devices.

SUMMARY OF THE INVENTION

The present invention provides a device including a first element substrate configured to drive a driving element; a second element substrate configured to drive a driving element; a first signal input unit that is connected to an input terminal of the first element substrate via a first signal line; a second signal input unit that is connected to an input terminal of the second element substrate via a second signal line; and a signal output unit through which an output terminal of the first element substrate and an output terminal of the second element substrate are connected in parallel, wherein each of the first element substrate and the second element substrate includes a driving element, a first signal generation unit configured to output a first signal, a second signal generation unit configured to output a second signal, an input terminal, an output terminal, and a selection unit configured to receive a signal from the first signal generation unit and the second signal generation unit, select one of a state of the first signal, a state of the second signal, and a high-impedance state on the basis of the selection signal input from the input terminal, and output the state to the output terminal.

Further features of the present invention will become apparent from the following description of exemplary embodiments with reference to the attached drawings.

DESCRIPTION OF THE EMBODIMENTS

First Embodiment

Figure 1:
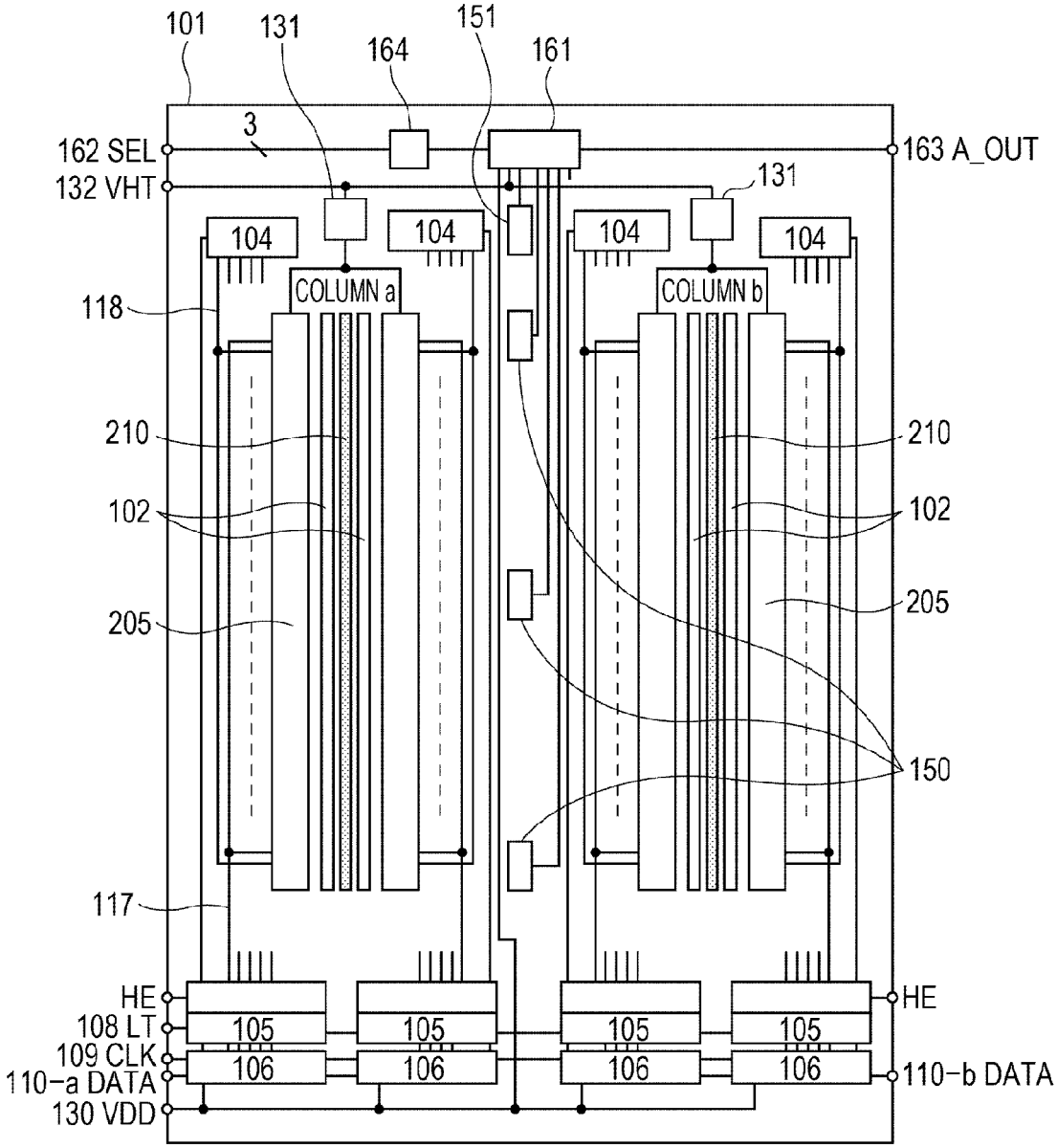
FIG. 1 illustrates the configuration of an element substrate in a first embodiment of the present invention.

FIG. 1 illustrates the configuration of an element substrate 101 in a first embodiment of the present invention. A heater 102 is a recording element that discharges ink. In the present embodiment, an element substrate including a recording element serving as a driving element will be described. A plurality of recording elements 102 are arranged in column a (two columns on both sides of the ink supply port) and in column b (two columns on both sides of the ink supply port).

A shift register (S/R) 106 temporarily stores M-bit recording data. A latch circuit 105 collectively holds recording data that is stored in the shift register (S/R) 106. A block selection circuit (decoder) 104 selects a desired block from N blocks in which a heater and a switching element are formed. The above-mentioned shift register 106, latch 105, and decoder 104 are control circuits for controlling the driving of the recording elements.

A clock signal CLK supplied from a device (for example, the main body of a printer) that controls an element substrate is input to a terminal 109. The M-bit recording data signal DATA that is serially transferred in synchronization with this clock signal are input from terminals 110-*a* and 110-*b* and are sequentially stored in the shift register 106. After that, this serial data is held in the latch circuit 105 in accordance with a latch signal LT input from a latch signal terminal 108. At this time, the signal that is input to the block selection circuit 104 is also serially transferred following the recording data signal, is converted into N block selection signals by a decoder, and are connected to groups 1 to M. The latch circuit 105 is connected to a recording element driving circuit 205 via a recording data signal 117.

An ink supply port 210 supplies ink from the reverse surface of the substrate. For this case, two supply ports are provided in the same substrate. A temperature detection element 150 is provided at three places in the element substrate. For the temperature detection element 150, a temperature detection element using, for example, temperature characteristics of voltage-electric current characteristics of a p-n junction diode is used. A resistance monitoring element 151 is used to monitor the resistance value of a heater serving as a recording element, and has a resistance value corresponding to the resistance value of the heater built within the substrate. The temperature detection element 150 and the resistance monitoring element 151 are information generation units (signal generation units) provided on the element substrate. The temperature detection elements 150 are temperature information generation units for generating temperature information. The temperature detection element 150 outputs voltage corresponding to level of temperature.

The outputs of the temperature detection elements 150 and the resistance monitoring element 151 are connected to the switching circuit 161, with an output being made from an analog output terminal 163 (A_OUT) by switching between the elements. A selection circuit 164 selects the outputs of the switching circuit 161. An input terminal 162 receives an analog output selection signal (SEL) from the outside and supplies this signal to the selection circuit 164. Furthermore, a logic power-supply voltage VDD 130 and a VHT voltage 132 are connected to the switching circuit 161. With this configuration, the output of the temperature detection element, the output of the resistance monitoring element, the logic power-supply voltage VDD and the VHT voltage are each output from the analog output terminal 163 at a desired time.

Figure 2:
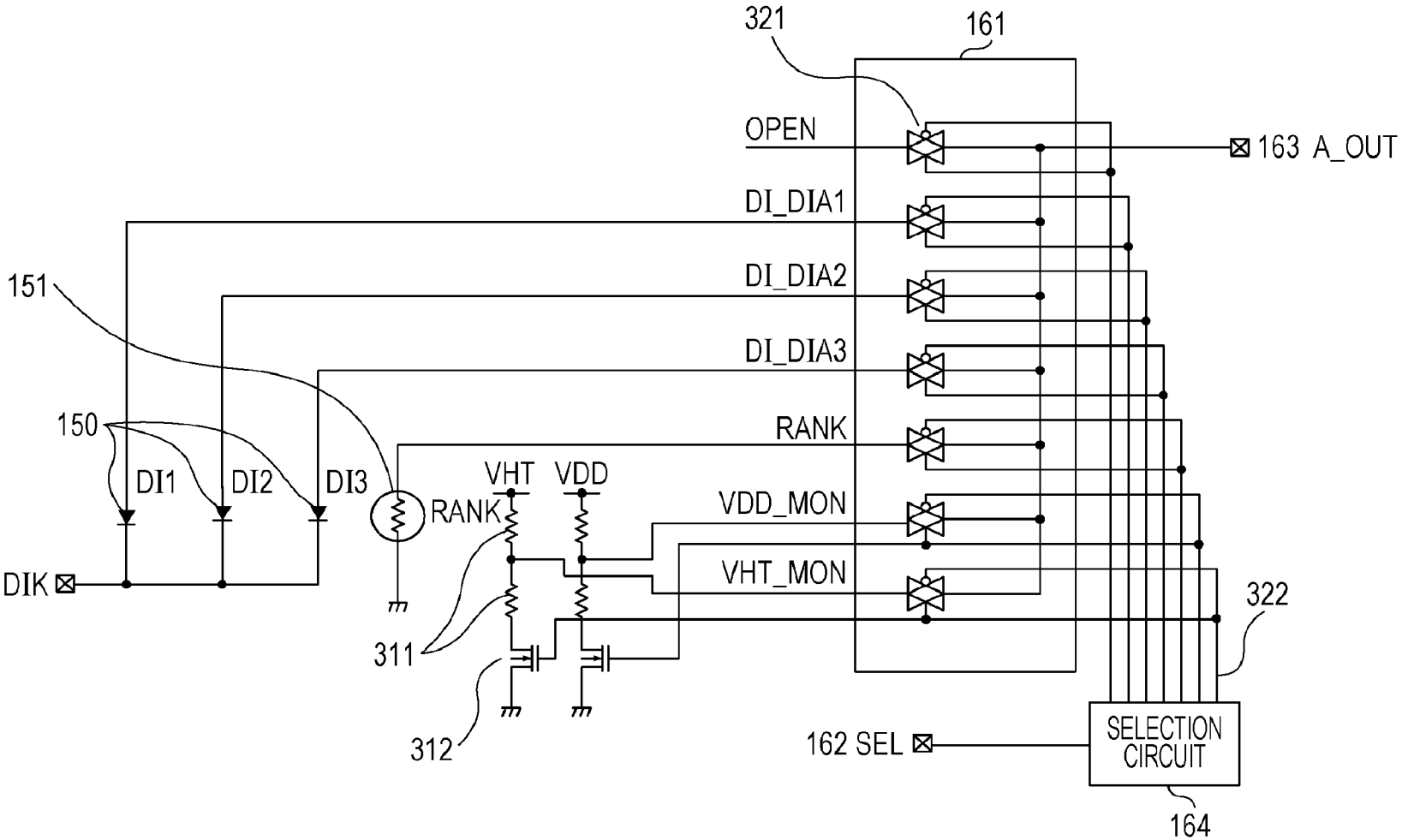
FIG. 2 illustrates a switching circuit 161 in the first embodiment of the present invention.

FIG. 2 illustrates the switching circuit 161. The switching circuit 161 includes a plurality of analog SWs 321. In the analog SWs 321, the temperature detection element 150, the resistance monitoring element 151, a voltage-dividing resistor for dividing a logic power-supply voltage VDD, and a voltage-dividing resistor for dividing a VHT voltage are connected to corresponding terminals thereof. These resistor circuits are, if put differently, circuits that generate voltage information for controlling the driving of the recording element.

One of the analog SWs 321 has reached a state of open channel (Open ch) in a high impedance (HZ) state. The other terminals of these analog SWs 321 are connected in common so as to be connected to the analog output terminal 163 (A_OUT).

The selection circuit 164 outputs an analog SW selection signal (selection information) 322 corresponding to the corresponding analog SW, with this signal allowing one analog SW to be selected. As a result, by controlling the analog SW selection signal 322, a signal is selectively output from the switching circuit 161. Since one of the analog SWs of FIG. 2 is in a state of open channel (Open ch), if the analog SW is selected, the analog output terminal 163 can be brought into an HZ state (high-impedance state).

The logic power-supply voltage VDD is connected to one of the terminals of a corresponding voltage-dividing resistor 311. The VHT voltage is connected to one of the terminals of a corresponding voltage-dividing resistor 311. The other terminals thereof are connected to a switching transistor 312. An analog SW selection signal for selecting a VDD voltage and a VHT voltage is input to the gate of the switching transistor 312. As a result, electric current flows through the voltage-dividing resistor 311 only when selection is made, and electric current does not flow through the voltage-dividing resistor when selection is not made.

As described above, a circuit for measuring a voltage in which the logic power-supply voltage VDD is divided, and a circuit for measuring a voltage in which the VHT voltage is divided are provided. For example, in a case where a p-n junction diode is used as a temperature detection element, the output voltage thereof is substantially from 0.6 to 0.7 volts at room temperature. If the VDD voltage is 3.3 volts and the VHT voltage is 24 volts, the value of the voltage-dividing resistor 311 is determined so that those voltages become 0.6 to 0.7 volts.

Figure 3:
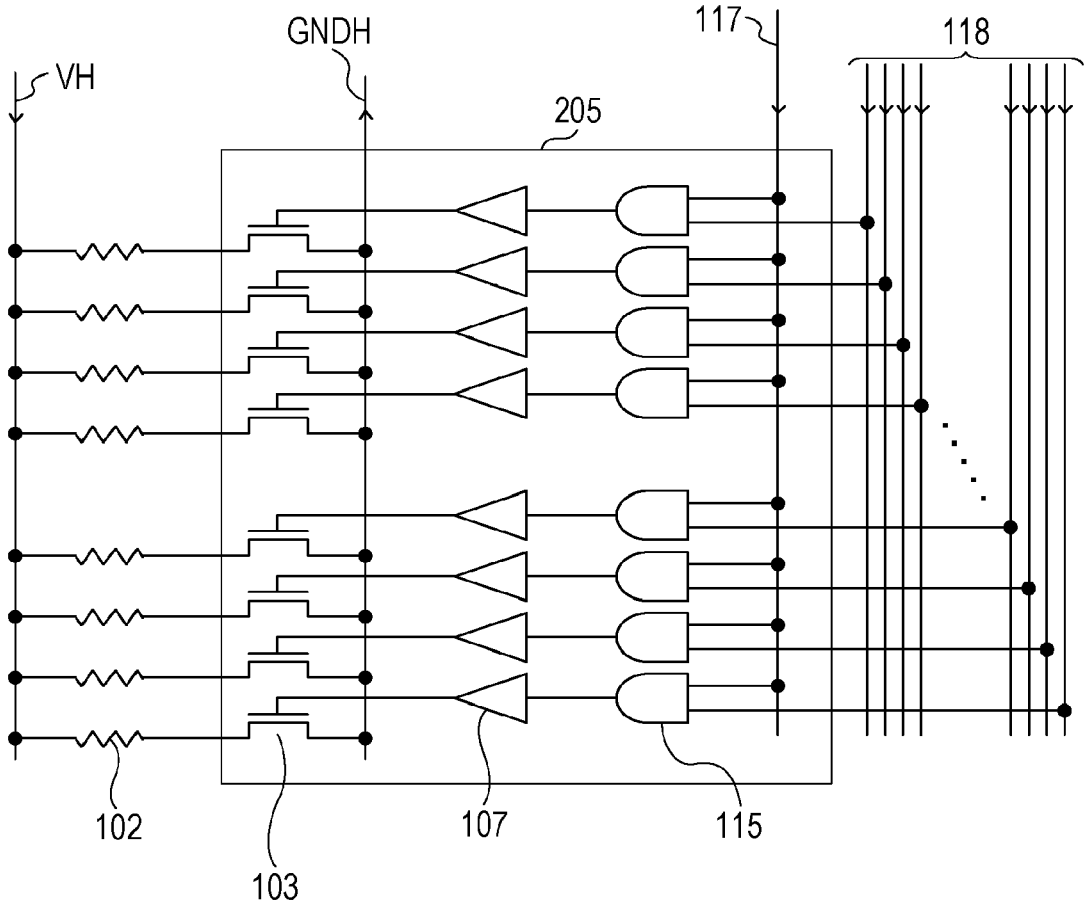
FIG. 3 is an illustration of a recording element driving circuit 205.

FIG. 3 is an illustration of the recording element driving circuit 205. The recording element driving circuit 205 includes a heater selection circuit 115, a voltage conversion circuit 107, and a switching element 103. The heater selection circuit 115 is a circuit for selecting an arbitrary heater. The heater selection circuit 115 performs the logical AND of the recording data signal 117, the block selection signal 118, and outputs the result to the voltage conversion circuit 107. The voltage conversion circuit 107 converts the voltage level of the output signal of the heater selection circuit 115 into a voltage level for driving a switching element. Here, the heater 102, the switching element 103, and the heater selection circuit 115 form one group in units of adjacent N components (in FIG. 3, N is 4). M (plural) of this group are provided to form a recording element sequence. Recording elements in the group are driven in a pre-specified order at mutually different times in a fixed period in accordance with the signals of the block selection signal 118. Such a driving is known as so-called time-division driving. The block selection signal 118 is a signal for controlling the driving order of the recording elements of the group.

Figures 4A, 4B:
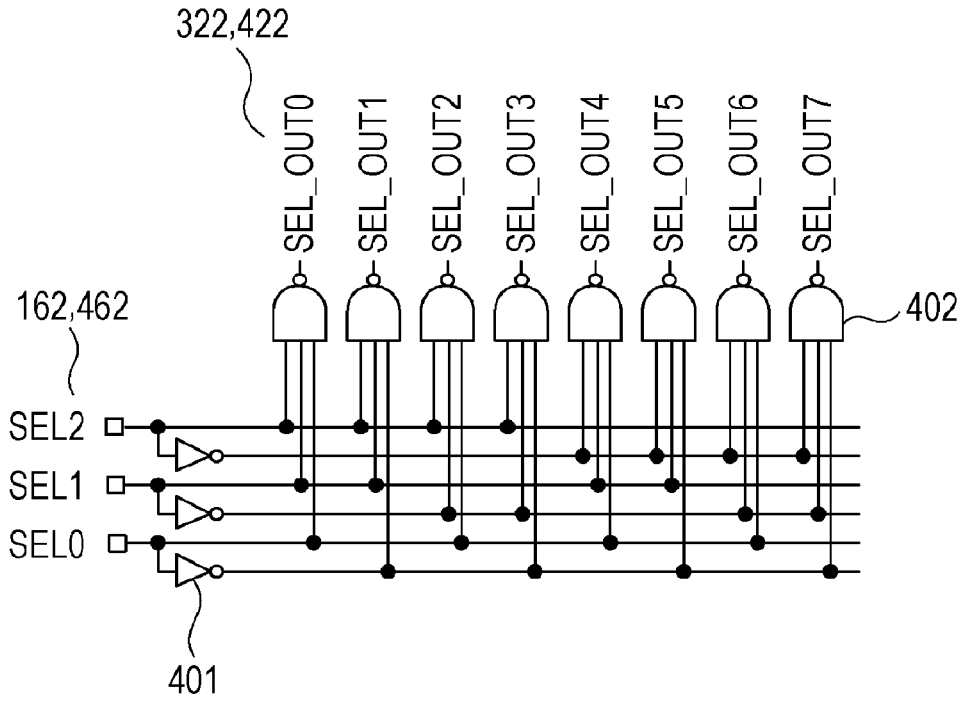
FIGS. 4A and 4B illustrate the configuration of a selection circuit 164.

FIG. 4A illustrates the configuration of the selection circuit 164. Here, a circuit configuration in a case where the number of analog SW selection signals 322 is eight is shown. The SEL signal 162 is formed of 3 bits (from SEL0 to SEL2). The selection circuit 164, which is constituted by an inverter 401 and a NAND circuit 402, is able to generate eight signals of SEL_OUT0 to SEL_OUT7, which serve as the analog SW selection signals 322. FIG. 4B illustrates a truth table for selection circuits, in which by determining the logic states of the input terminals SEL0 to SEL2, the outputs of SEL_OUT0 to SEL_OUT7 can be uniquely performed. For example, if all of SEL0 to SEL2 are L, the SEL_OUT0 becomes effective.

Figure 5:
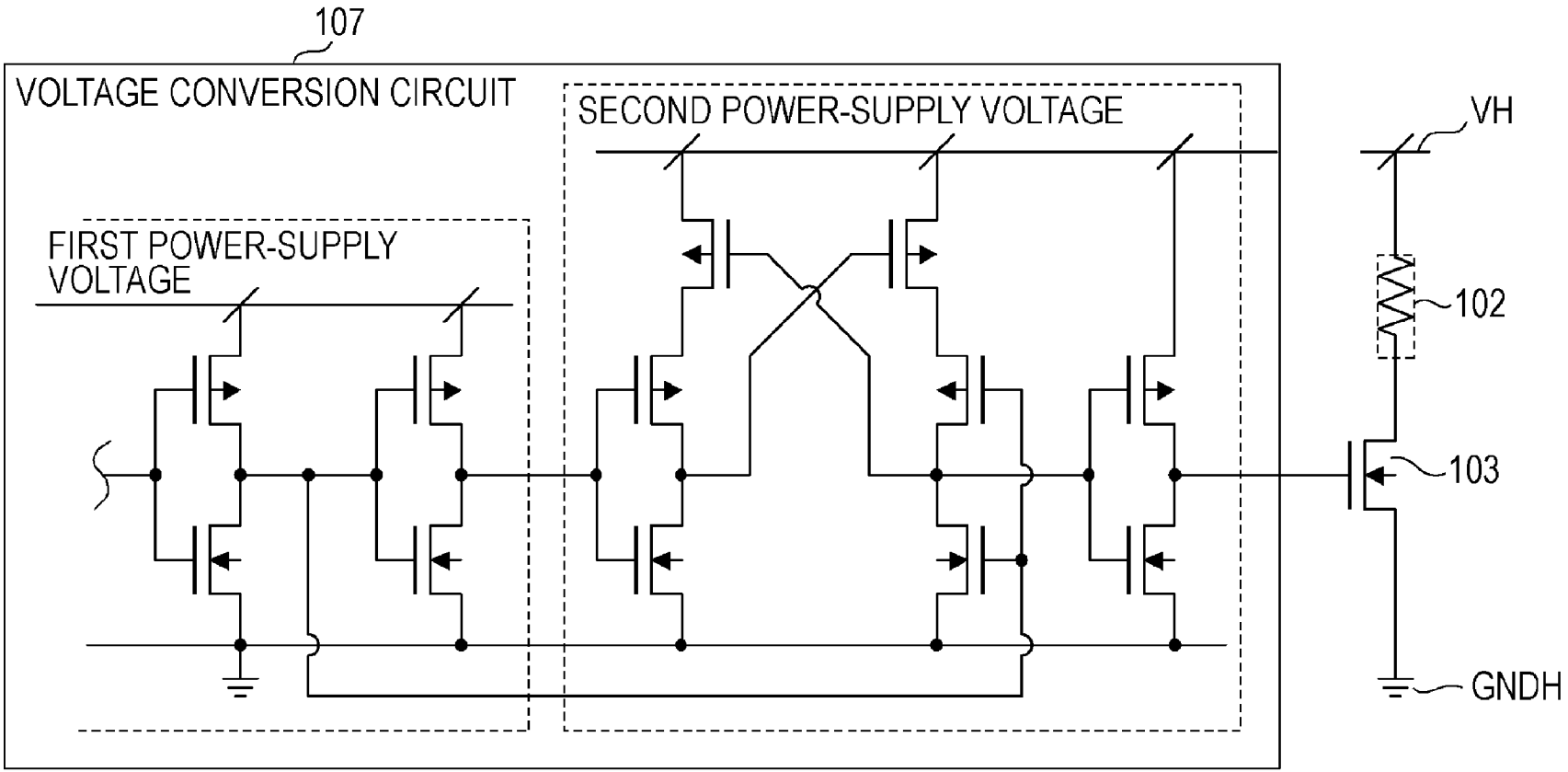
FIG. 5 illustrates the configuration of a voltage conversion circuit 107.

FIG. 5 illustrates the configuration of the voltage conversion circuit 107. With this configuration, the voltage is converted into a voltage (second power-supply voltage) in which the voltage amplitude of the signal is higher than the voltage amplitude (first power-supply voltage) of the output of the heater selection circuit. The converted signal is applied to the gate of the MOS transistor 103 that is a switching element, causing electric current to flow through the heater 102 connected to the MOS transistor 103 so as to cause it to be driven. At this point, the reason why the heater 102 is converted into the higher second voltage is that, by increasing the voltage applied to the gate of the heater driving MOS transistor 103, the ON resistance thereof is decreased, making it possible to cause electric current to flow through the heater at high efficiency. It is preferable that the voltage value of the second power-supply voltage be set higher as much as possible without exceeding the breakdown voltage of the circuit and the gate breakdown voltage of the MOS. The driving voltage generation circuit 131 (VHT buffer) shown in FIG. 1 generates a desired second power-supply voltage from the VHT voltage 132.

Figure 6:
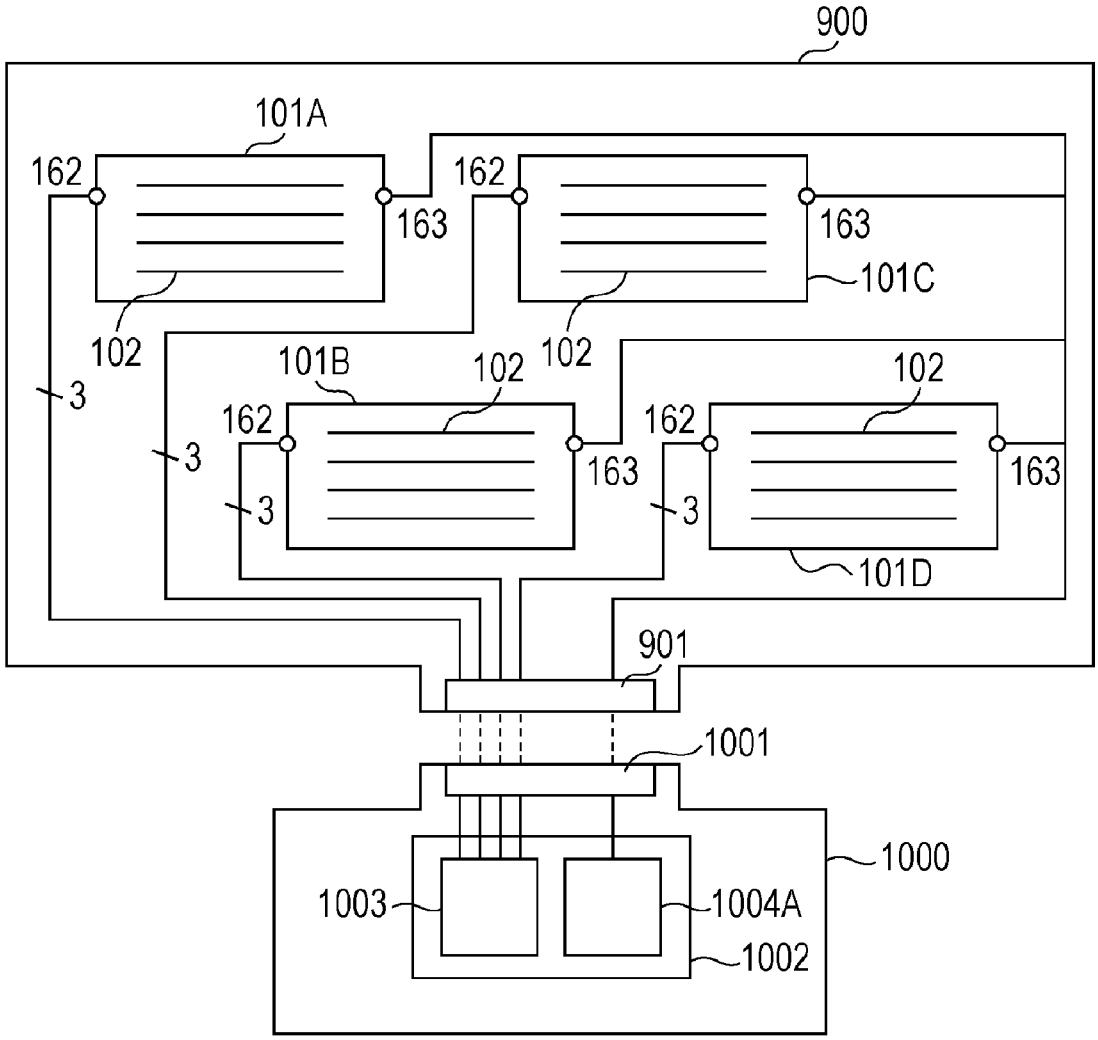
FIG. 6 illustrates a recording head in the first embodiment of the present invention.

FIG. 6 illustrates a recording head in the first embodiment of the present invention. A recording head 900 is a device including four recording element substrates 101A to 101D. Each of the recording element substrates 101A to 101D includes four heater sequences, as shown in FIG. 1. A connection unit 901 is connected to the device (the main body of the recording device). The connection unit 901 includes an input unit that is connected to each of the input terminals 162 of four element substrates, and an output unit that is connected in common to the output terminals 163 of four element substrates. For the sake of simplicity of description, a minimum of necessary signal lines are described. As described with reference to FIG. 1 to FIGS. 4A and 4B, in each recording element substrate, a 3-bit selection signal (SEL0 to SEL2) is input to the input terminal 162. This selection signal is supplied individually from the connection unit 901. Additionally, an analog signal is output from the analog output terminal 163 in accordance with a selection signal. This analog output terminal 163 is connected to the analog output terminal 163 of each recording element substrate.

A recording device 1000 connected to the recording head 900 includes a connection unit 1001. A control unit 1002 performs the control of the recording device 1000. The control unit 1002 includes a signal generation unit 1003 for generating a selection signal to be output to the recording head, and a processing circuit 1004A for processing an analog signal input from the recording head. The control unit 1002 includes a CPU, a memory, an application specific integrated circuit (ASIC), and the like.

The signal generation unit 1003 outputs, for example, a selection signal (SEL0 to SEL2) for obtaining information on the temperature detection element 150 of the recording element substrate 101A. In this case, the signal generation unit 1003 outputs a signal for selecting an open channel to a recording element substrate 101B, a recording element substrate 101C, and a recording element substrate 101D. As described above, if a selection signal is output, the output terminals of the recording element substrates 101B, 101C, and 101D reach a high-impedance state. Thus, it is possible to obtain the information of the temperature detection element of the recording element substrate 101A. Similarly, in a case where the information of the temperature detection element 150 of the recording element substrate 101B is to be obtained, a signal for selecting an open channel is output to the other recording element substrates 101A, 101C, and 101D.

As described above, the signal generation unit 1003 generates a selection signal so that one of four element substrates is selected. As a result, even in a state in which the analog output terminals 163 are connected in common, it is possible for the recording device to appropriately receive a signal. The signal generation unit 1003 performs the control of selecting four element substrates in accordance with the operation content of the recording device.

With the above-described configuration, while suppressing an increase in the number of terminals of the signal that is output to the device (recording device) by the device (recording head), it is possible to obtain signals in an analog format and information from a plurality of element substrates.

Second Embodiment

Figure 7:
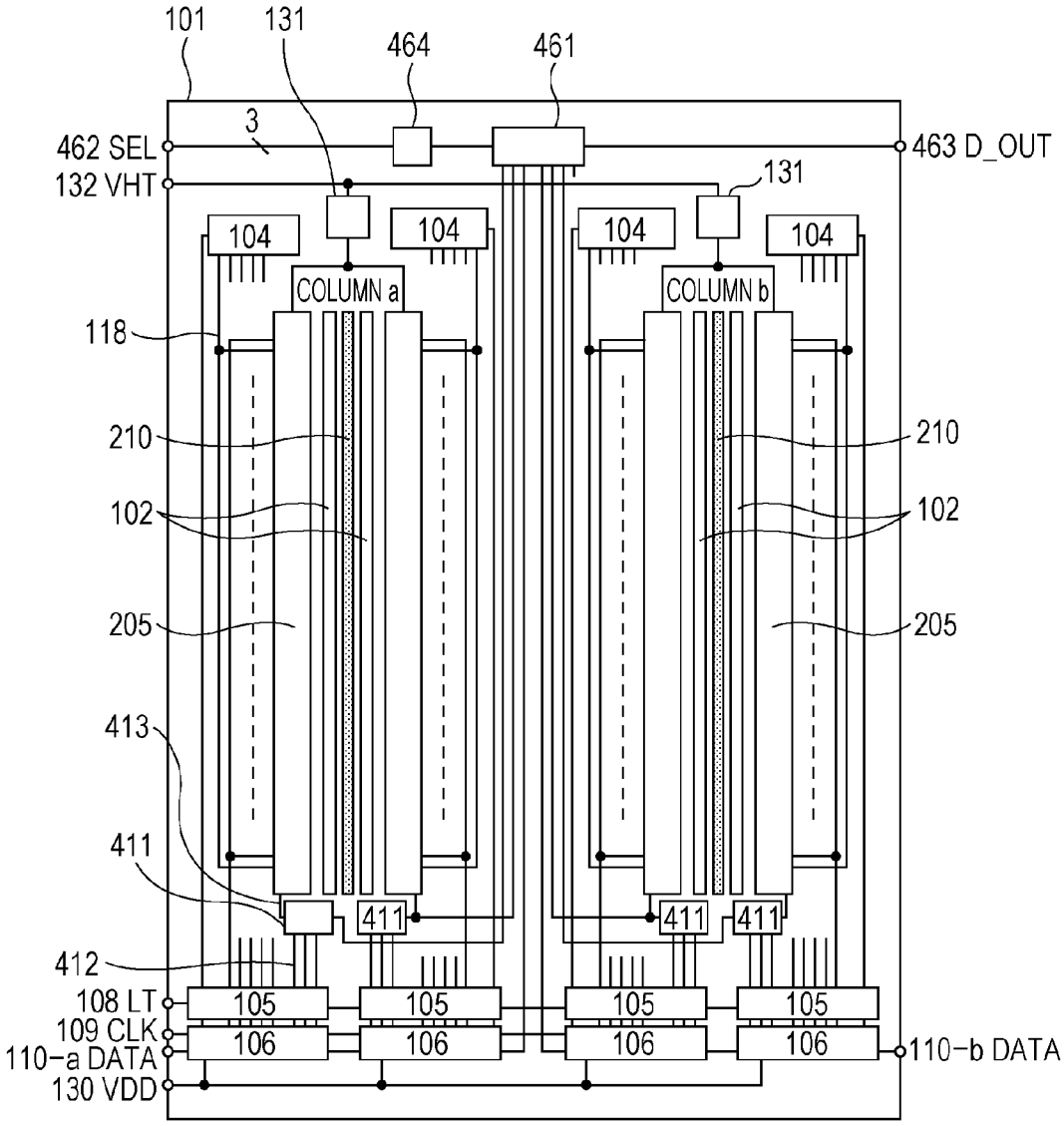
FIG. 7 illustrates the configuration of an element substrate in a second embodiment of the present invention.
Figure 9:
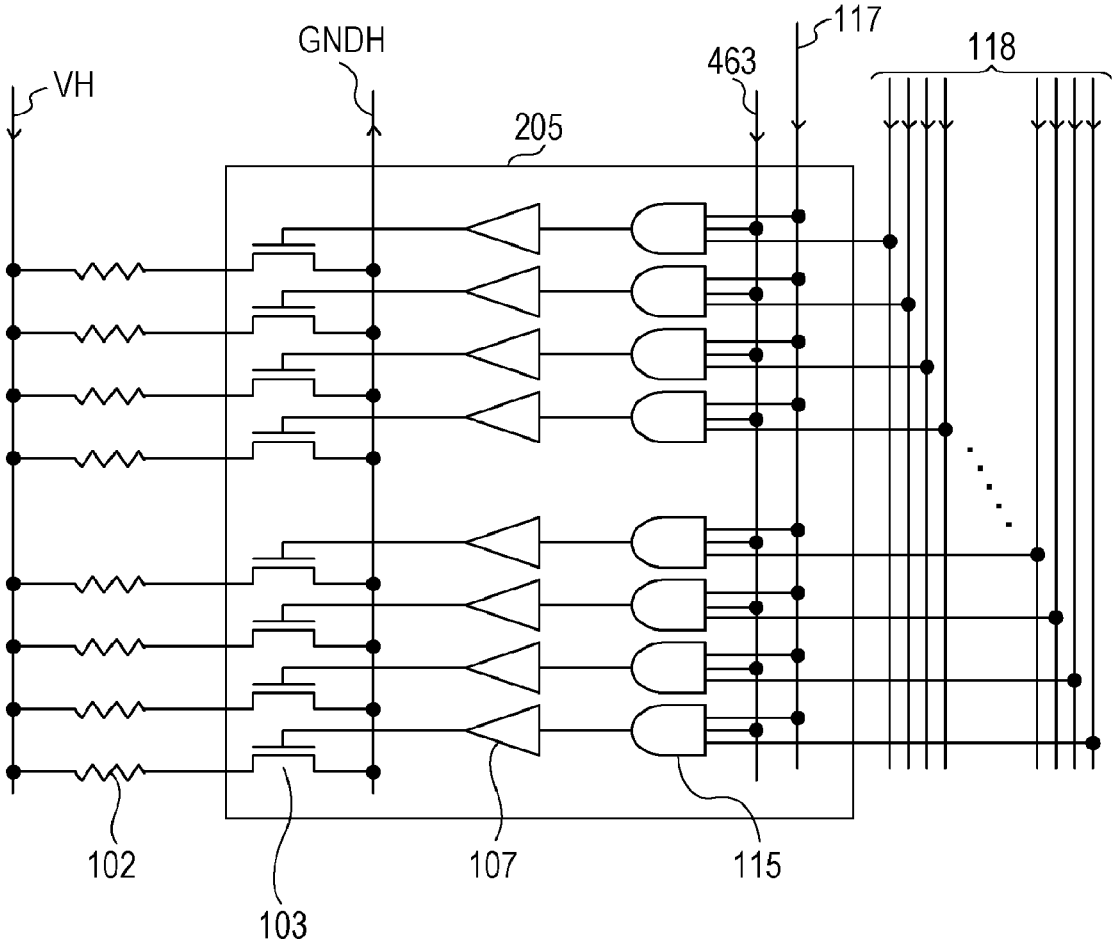
FIG. 9 illustrates a recording element driving circuit 205 in the second embodiment of the present invention.

FIG. 7 illustrates the configuration of an element substrate in a second embodiment of the present invention. Descriptions of components identical to those of FIG. 1 are omitted, and the differences will be described. In FIG. 7, a heat signal generation circuit 411 generates a heat (HE) signal 413 to be supplied to a switching element for driving a heater. The heat signal generation circuit 411 generates a heat signal 413 on the basis of a heat pulse width signal (pulse width information) 412. The heat pulse width signal (pulse width information) 412 is serially transferred to the data signal 110 through the same terminal as that of the shift register 106. In the recording element driving circuit 205 shown in FIG. 9, regarding the heat signal 413 generated in the heat signal generation circuit 411, the heater selection circuit 115 performs the logical AND of the recording data signal 117, the block selection signal 118, and the heat signal 463, and outputs the result to the voltage conversion circuit 107.

A switching circuit 461 receives the heat signal 413 corresponding to each of heater sequences 205, switches these signals, and outputs a signal from a digital output terminal 463 (D_OUT). Furthermore, the switching circuit 461 also receives recording data signals that are input to the two shift registers 106. The selection circuit 464 selects the outputs of the switching circuit 461. The input terminal 462 receives a digital output selection signal (SEL) to be input to the selection circuit 464. Therefore, as a result of selecting and outputting one of the heat signal and the recording data signal, it is possible to confirm the content of the signal.

Figure 8:
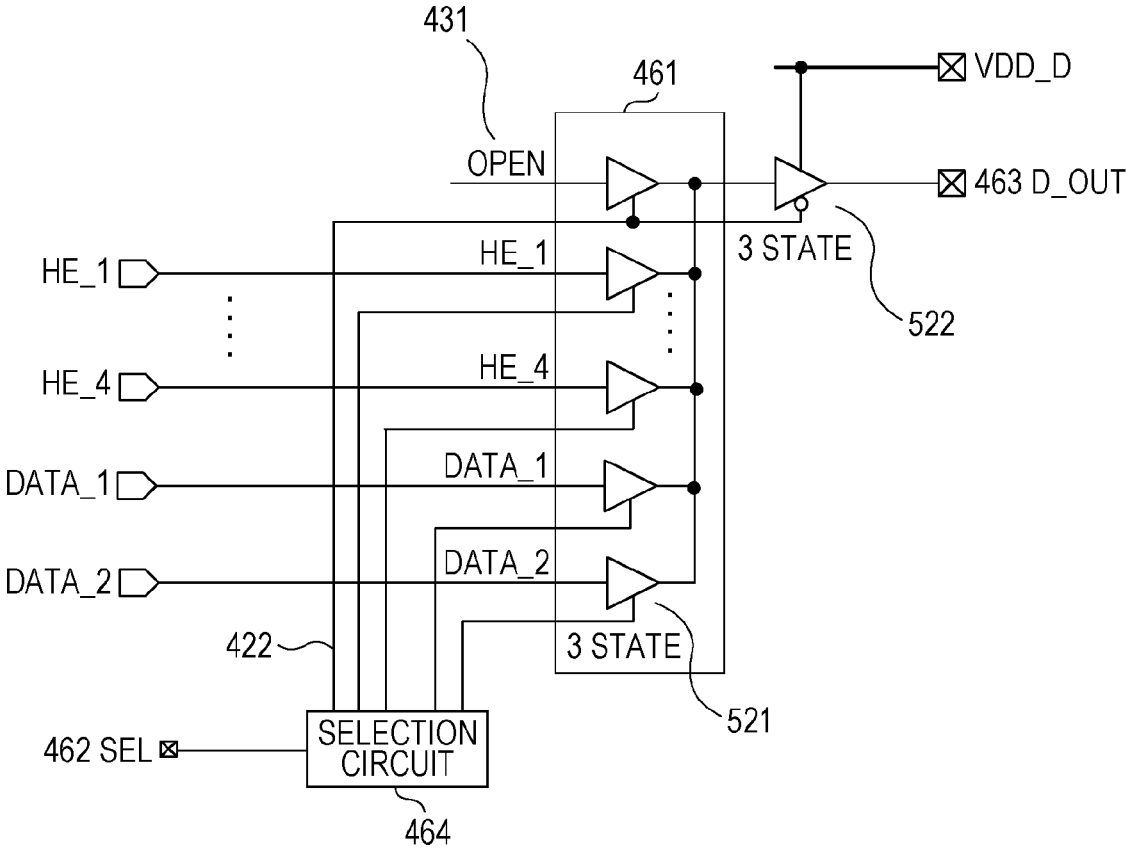
FIG. 8 illustrates a switching circuit 461 in the second embodiment of the present invention.

FIG. 8 illustrates the switching circuit 461. The switching circuit 461 includes a plurality of 3-state buffers 521. The 3-state buffer 521 outputs three states of Hi, Lo, and HZ. Four heat signals (HE_1 to HE_4) and two recording data signals (DATA_1, DATA_2) are connected to each state buffer. Additionally, the output terminals are connected in common. The commonly connected outputs are further input to a 3-state buffer 522. The output of the 3-state buffer 522 is connected to the digital output terminal 463.

Similarly to the first embodiment, the selection circuit 464 outputs a digital signal selection signal 422 corresponding to each 3-state buffer 521, thereby causing the states of the respective 3-state buffers to be uniquely selected. Then, the signal 422 is output so that those buffers other than the selected 3-state buffer enter an HZ state (high-impedance state). Therefore, when one of four heat signals (HE_1 to HE_4) and two recording data signals (DATA_1, DATA_2) is selected, the selected signal is output through the 3-state buffer 522 and the digital output terminal 463.

On the other hand, when none of the four heat signals (HE_1 to HE_4) and the two recording data signals (DATA_1, DATA_2) is selected, the 3-state buffer 522 is brought into an HZ (high impedance). As a result, the digital output terminal 463 is brought into an HZ state (high-impedance state). No signal is output from the digital output terminal 463. In the present embodiment, the input of the 3-state buffer 521 corresponding to an open channel (Open ch) 431 is connected to the GND.

Figure 10:
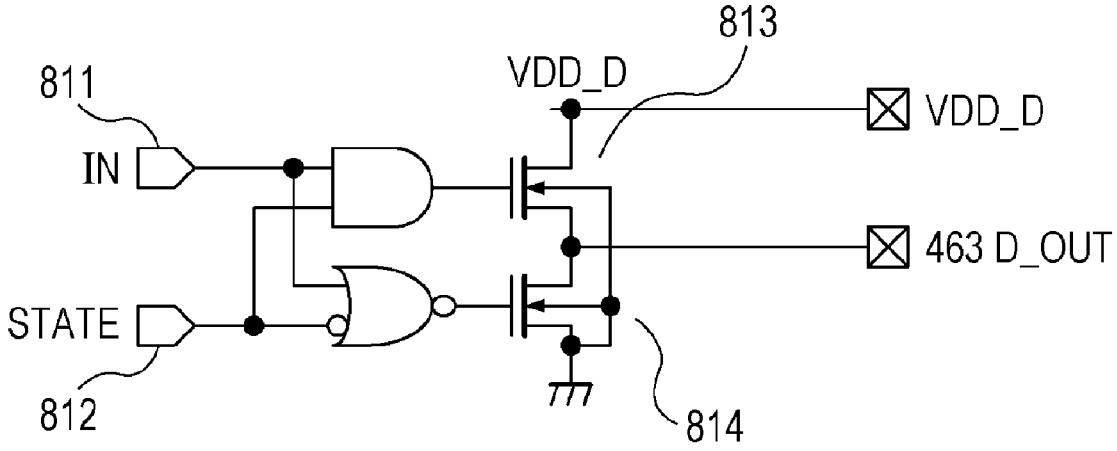
FIG. 10 illustrates a 3-state buffer 522 in the second embodiment of the present invention.

FIG. 10 illustrates an embodiment of the 3-state buffer 522. An input terminal 811 receives a signal, that is, a signal that is input to a state terminal 812. Reference numerals 813 and 814 each denote an nMOS transistor at the output stage. With this configuration, even if a signal is input by mistake, a parasitic transistor inside the substrate operates, so that abnormal electric current can be prevented from flowing through the 3-state buffer 522.

Figure 11:
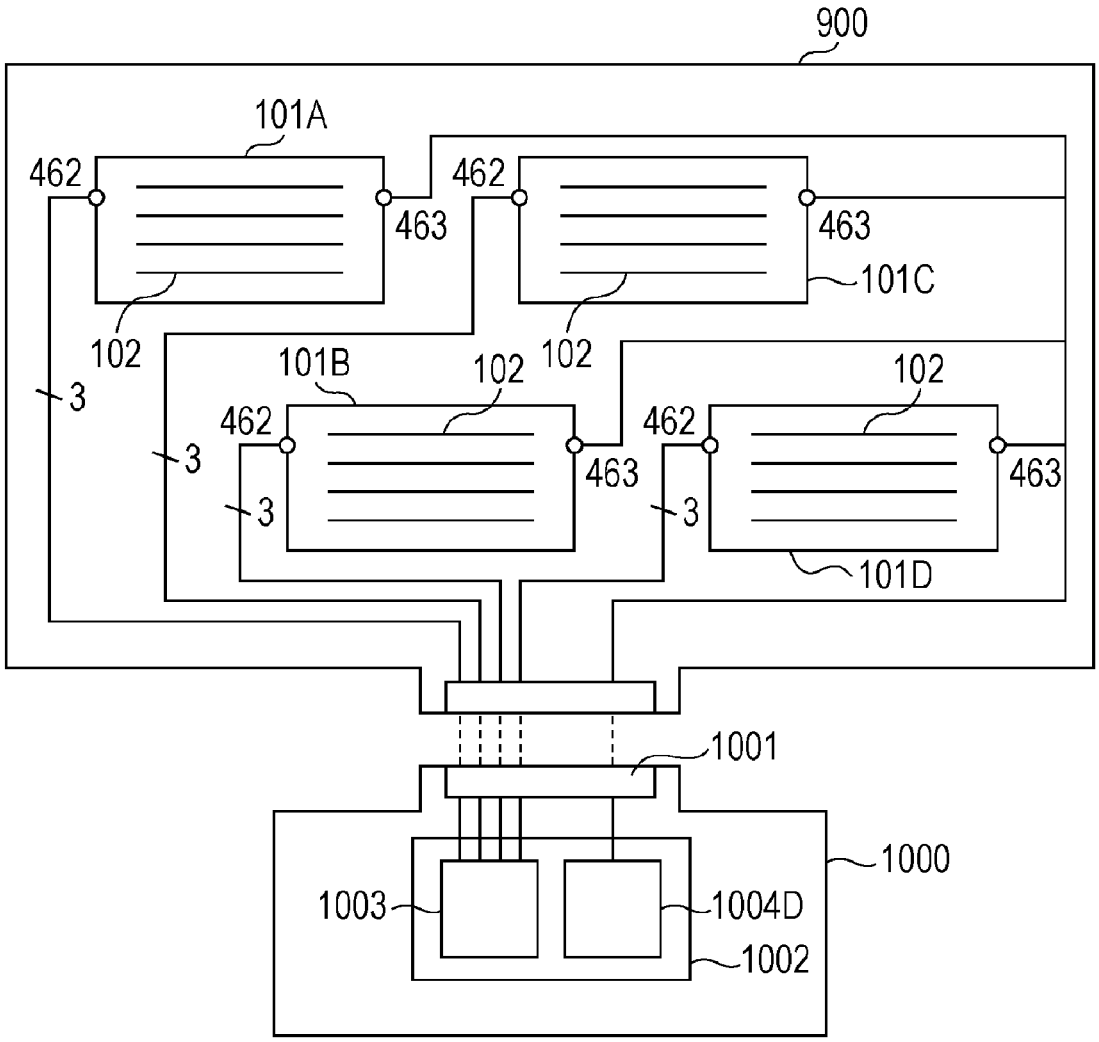
FIG. 11 illustrates a recording head in the second embodiment of the present invention.

FIG. 11 illustrates a recording head in the second embodiment of the present invention. Descriptions of the same points as those of the first embodiment are omitted, and the differences will be described. In the second embodiment, a 3-bit selection signal (SEL0 to SEL2) is input to the input terminal 462. A digital signal is output from the digital output terminal 463 in accordance with this selection signal. The recording device 1000 includes a processing circuit 1004D for processing a digital signal, the processing circuit 1004D taking the place of the processing circuit 1004A for processing an analog signal in accordance with the first embodiment. Since the control of the signal generation unit 1003 is also the same as that of the first embodiment, the description thereof is omitted.

With the above-described configuration, while suppressing an increase in the number of terminals of the signal that is output to the device (the recording device) by the device (recording head), it is possible to obtain a signal in a digital format and information from a plurality of element substrates.

Third Embodiment

Figure 12:
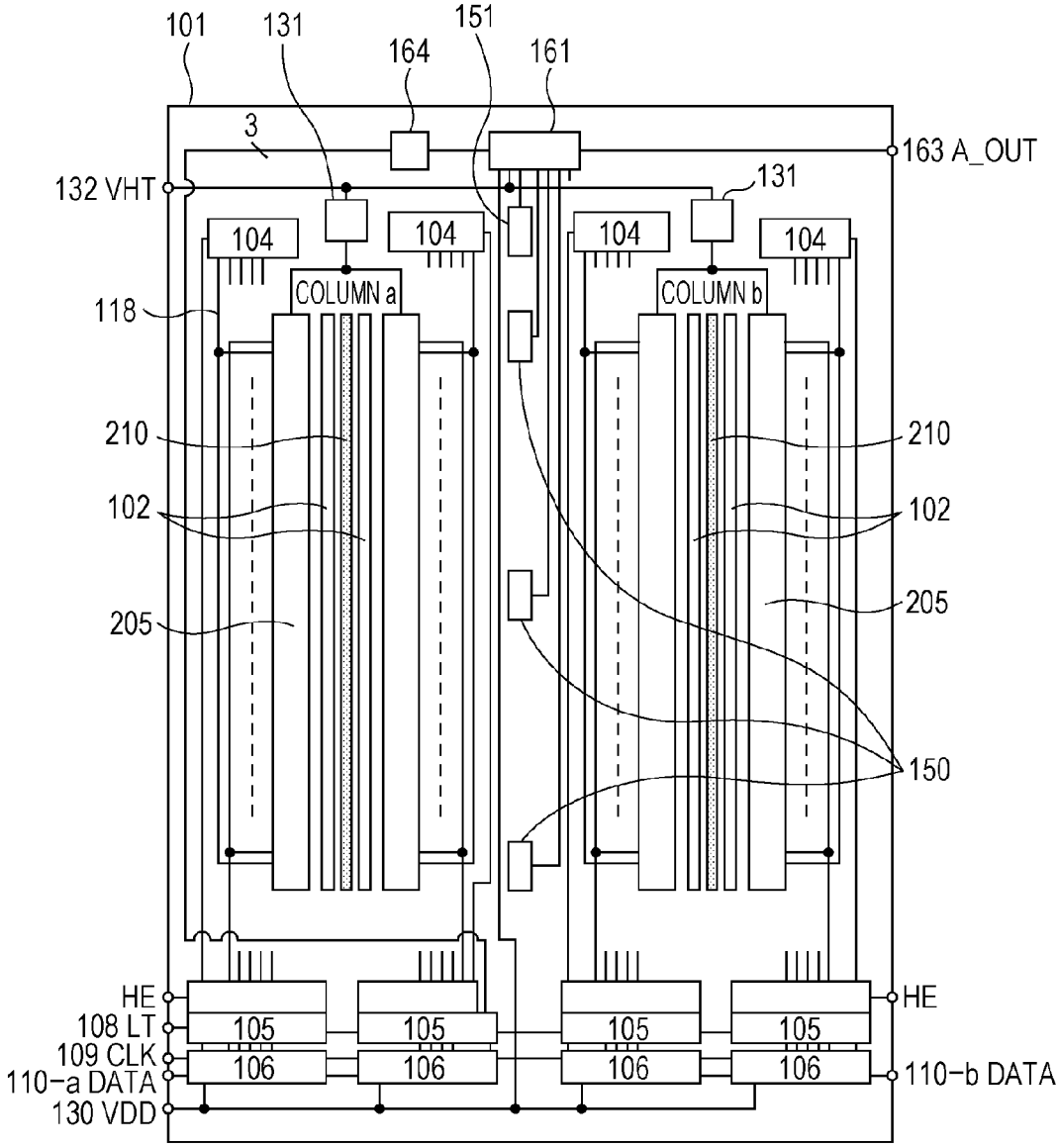
FIG. 12 illustrates the configuration of an element substrate in a third embodiment of the present invention.

FIG. 12 illustrates the configuration of an element substrate in a third embodiment of the present invention. Descriptions of the components of the same reference numerals as those of FIG. 1 are omitted. In FIG. 1, a 3-bit signal (SEL0 to SEL2) is input from the input terminal 162. In FIG. 12, a selection signal, together with an M-bit recording data signal DATA that is serially transferred, is input. That is, the selection signal (SEL0 to SEL2) is input through a terminal 110-*a* from the recording device. This selection signal is input to the shift register (S/R) 106, is held by the latch circuit 105, and is transferred to the selection circuit 164.

Figure 14:
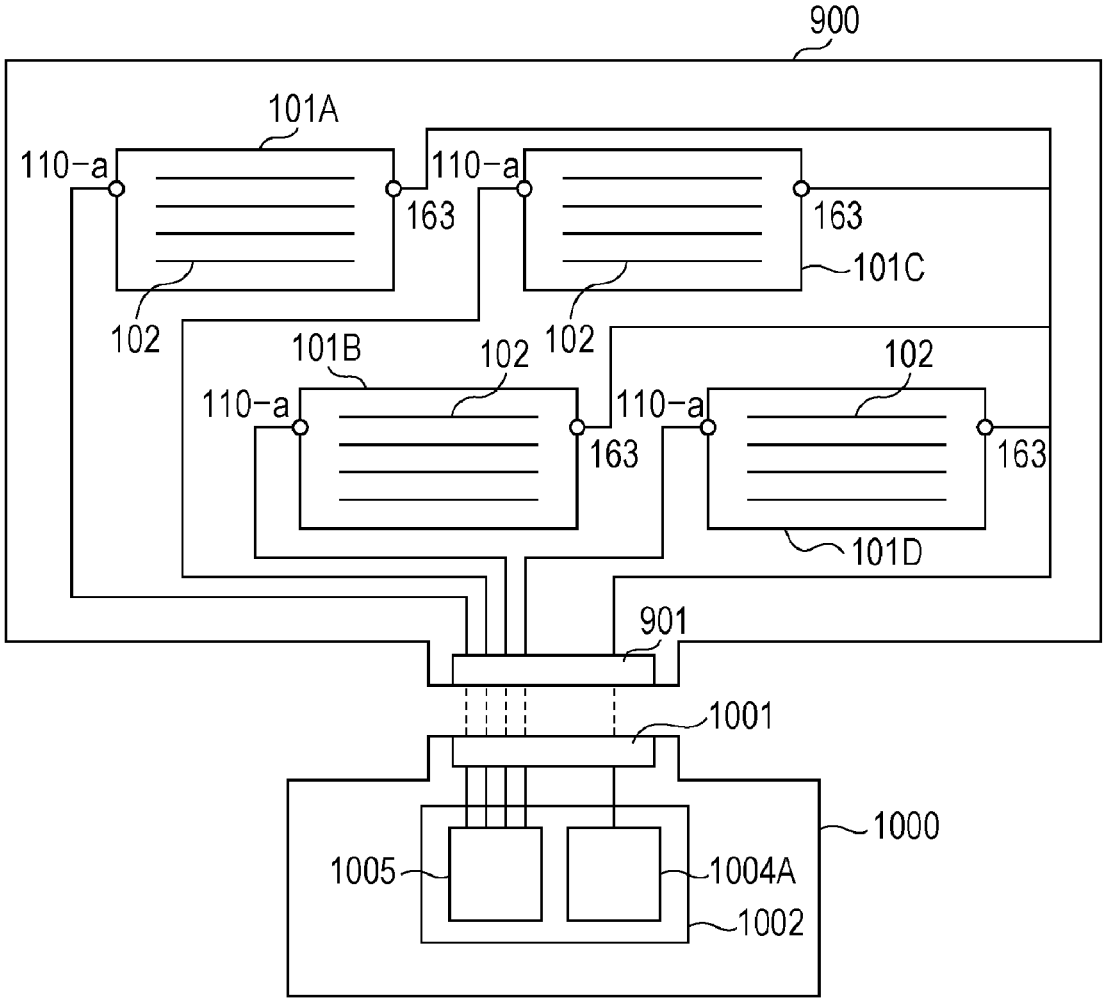
FIG. 14 illustrates a recording head in the third embodiment of the present invention.

FIG. 14 illustrates a recording head in the third embodiment of the present invention. Descriptions of the same points as those of the first embodiment are omitted, and the differences will be described. In the third embodiment, a 3-bit selection signal (SEL0 to SEL2) in a serial format is input to the terminal 110-*a*. An analog signal is output from the analog output terminal 163 in accordance with this selection signal. Similarly to the first embodiment, the recording device 1000 includes the processing circuit 1004A for processing an analog signal. Furthermore, in the recording device 1000, the signal generation unit 1005 generates serial data unlike the first embodiment and the second embodiment. The signal generation unit 1005 transfers, for example, the information of the selection signal before the recording data signal DATA.

With the above-described configuration, as a result of sharing the input terminals of the selection signal with an input terminal of another signal, it is possible to obtain a signal in an analog format and information from a plurality of element substrates while suppressing an increase in the number of terminals for the signals that are input from the recording device by the recording head.

Fourth Embodiment

Figure 13:
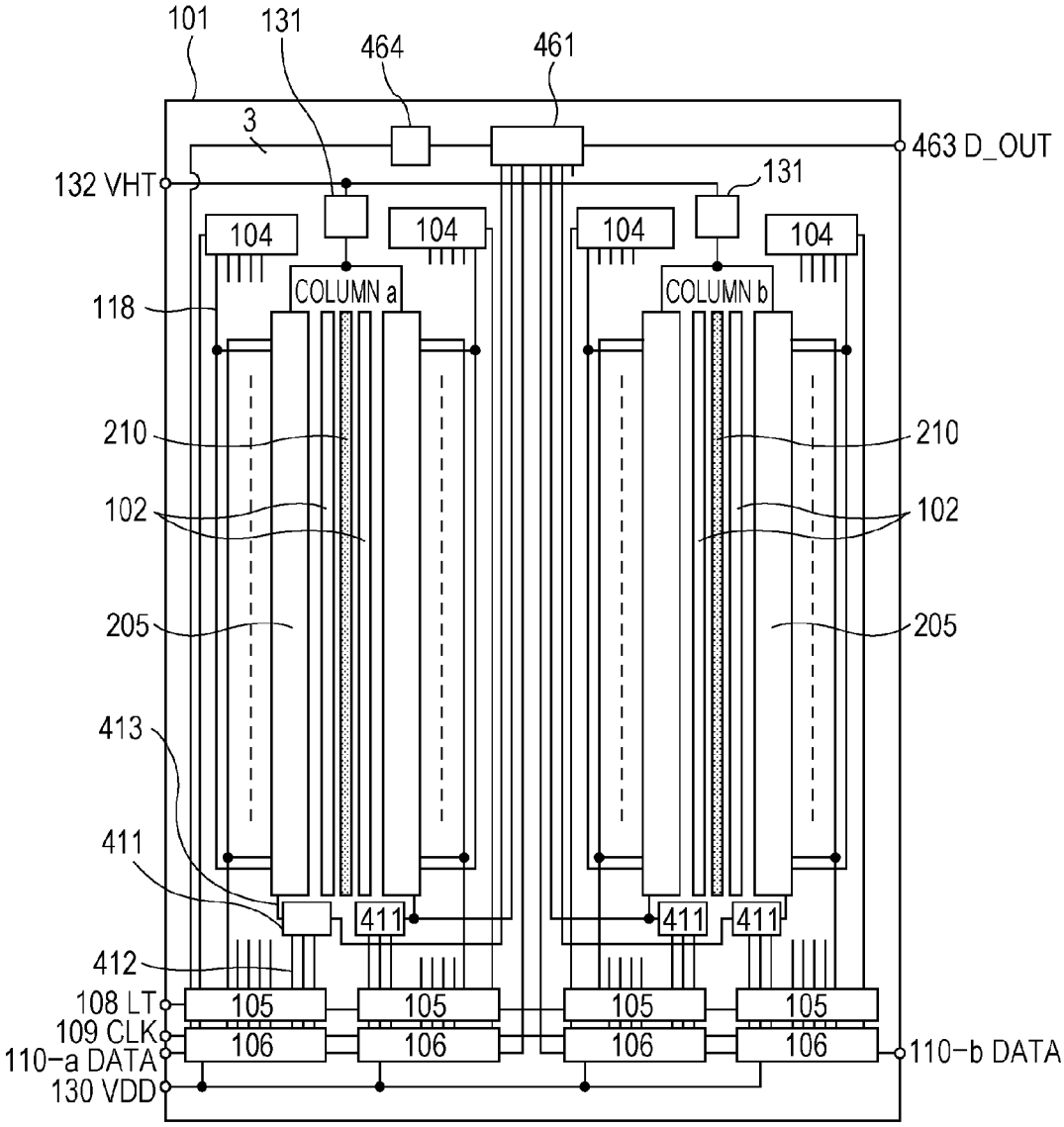
FIG. 13 illustrates the configuration of an element substrate in a fourth embodiment of the present invention.

FIG. 13 illustrates the configuration of an element substrate in a fourth embodiment of the present invention. Descriptions of the components of the same reference numerals as those of the configuration of FIGS. 1 and 12 are omitted. In FIG. 12, an analog signal is output from the recording head. However, in FIG. 13, a digital signal is output from the recording head. Similarly to the third embodiment, a 3-bit selection signal (SEL0 to SEL2) in a serial format is input to the terminal 110-*a*. The description of the recording head in the fourth embodiment is omitted.

With the above-described configuration, by sharing the input terminals of the selection signal with an input terminal for another signal, while suppressing an increase in the number of terminals of signals to be input from the recording device by the recording head, it is possible to obtain a signal in a digital format and information from a plurality of element substrates.

Other Embodiments

In the foregoing, the recording head has been described by using a device as an example. It is possible for another device to take the same configuration. For example, the present invention can be applied to a reading device for controlling a reading unit including an optical sensor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-140914 filed Jun. 21, 2010, which is hereby incorporated by reference herein in its entirety.

What is claimed is:

1. A device comprising:

a first element substrate configured to drive a driving element;

a second element substrate configured to drive a driving element;

a first signal input unit that is connected to an input terminal of the first element substrate via a first signal line;

a second signal input unit that is connected to an input terminal of the second element substrate via a second signal line; and a signal output unit through which an output terminal of the first element substrate and an output terminal of the second element substrate are connected in parallel, wherein each of the first element substrate and the second element substrate includes a driving element, a first signal generation unit configured to output a first signal, a second signal generation unit configured to output a second signal, an input terminal, an output terminal, and a selection unit configured to receive a signal from the first signal generation unit and the second signal generation unit, select one of a state of the first signal, a state of the second signal, and a high-impedance state on the basis of the selection signal input from the input terminal, and output the state to the output terminal.

2. The device according to claim 1, wherein the first signal generation unit and the second signal generation unit include an element configured to detect temperature.

3. The device according to claim 1, wherein the first signal generation unit and the second signal generation unit include a circuit configured to measure a voltage for controlling driving of the driving element.

4. The device according to claim 1, wherein the selection unit includes a decoding circuit configured to decode the selection signal.

5. The device according to claim 1, wherein the driving element includes a recording element.

6. An apparatus for controlling the device according to claim 1, comprising:

a signal generation unit configured to output a signal for selecting the state of the first signal to the first signal input unit and output a signal for selecting the high-impedance state to the second signal input unit.

* * * * *